United States Patent [19]

Stalder et al.

[11] Patent Number: 4,696,155

[45] Date of Patent: Sep. 29, 1987

[54] FRICTION SPINNING DEVICE CONTAINING A FRICTION SPINNING MEANS AND METHOD OF USE OF THE FRICTION SPINNING DEVICE

[75] Inventors: Herbert Stalder, Kollbrunn; Arthur Würmli, Winterthur; Josef Baumgartner, Sirnach; Emil Briner, Winterthur, all of Switzerland

[73] Assignee: Maschinenfabrik Rieter AG, Winterthur, Switzerland

[21] Appl. No.: 874,522

[22] Filed: Jun. 16, 1986

[30] Foreign Application Priority Data

Jun. 18, 1985 [DE] Fed. Rep. of Germany ..... 3521665

[51] Int. Cl.[4] ..... D01H 1/135; D01H 7/885

[52] U.S. Cl. ..... 57/401; 57/411

[58] Field of Search ..... 57/400, 401, 408, 411, 57/413

[56] References Cited

U.S. PATENT DOCUMENTS

| | | | |
|---|---|---|---|
| 4,168,601 | 9/1979 | Didek et al. | 57/401 |
| 4,399,650 | 8/1983 | Parker et al. | 57/401 |
| 4,584,832 | 4/1986 | Stahlecker | 57/401 |
| 4,601,167 | 7/1986 | Fuchs | 57/401 |
| 4,606,187 | 8/1986 | Stahlecker | 57/401 |

FOREIGN PATENT DOCUMENTS

| | | |
|---|---|---|
| 2361313 | 7/1974 | Fed. Rep. of Germany . |
| 2655338 | 8/1977 | Fed. Rep. of Germany . |
| 2655337 | 8/1977 | Fed. Rep. of Germany . |
| 3114093 | 1/1982 | Fed. Rep. of Germany . |
| 3323189 | 1/1983 | Fed. Rep. of Germany . |
| 3340825 | 6/1984 | Fed. Rep. of Germany . |
| 3300636 | 7/1984 | Fed. Rep. of Germany . |
| 3316656 | 11/1984 | Fed. Rep. of Germany . |
| 3318924 | 11/1984 | Fed. Rep. of Germany . |
| 1231198 | 5/1971 | United Kingdom . |

*Primary Examiner*—Donald Watkins

*Attorney, Agent, or Firm*—Werner W. Kleeman

[57] ABSTRACT

A friction spinning device has a pneumatic fiber transport passage or channel inclined at an angle to a perforated friction spinning element and a yarn formation position of the perforated friction spinning element is located at a spacing from an opening of the pneumatic fiber transport passage or channel. In such a friction spinning device, it is desired to ensure that the fibers located on the perforated friction spinning element are transported towards the yarn formation position neither parallel to nor at right angles to the yarn formation position. For this purpose, the perforations of the perforated friction spinning elements are so arranged that straight lines joining the perforation centers are disposed neither parallel to nor at right angles to the yarn formation position. In this way, fibers transported onto the perforated friction spinning element are laid on such perforated friction spinning element in the direction of the rows of perforations due to the intensity of the transporting air. In this way, a desired or appropriate disposition of these fibers is ensured.

13 Claims, 6 Drawing Figures

FRICTION SPINNING DEVICE CONTAINING A FRICTION SPINNING MEANS AND METHOD OF USE OF THE FRICTION SPINNING DEVICE

CROSS REFERENCE TO RELATED APPLICATIONS

This application is related to the commonly assigned: U.S. patent application Ser. No. 06/734,845, filed May 15, 1985, now U.S. Pat. No.4,660.371 and entitled "METHOD AND APPARATUS FOR PRODUCING A YARN", U.S. patent application Ser. No. 06/773,998, filed Sept. 9, 1985, now U.S. Pat. No. 4,628,679 and entitled "METHOD AND APPARATUS FOR THE PRODUCTION OF A YARN", and U.S. patent application Ser. No. 06/789,902, filed Oct. 10, 1985 and entitled "METHOD OF, AND APPARATUS FOR, PRODUCING A YARN AND FRICTION SPUN YARN PRODUCED BY SUCH METHOD OR APPARATUS".

This application is also related to the commonly assigned, co-pending U.S. patent application Ser. No. 06/874,521, filed June 16, 1986, now U.S. Pat. No. 4,646,513, granted Mar. 3,1987, and entitled "METHOD FOR PIECING A YARN IN A FRICTION SPINNING DEVICE".

BACKGROUND OF THE INVENTION

The present invention relates to a new and improved friction spinning device containing a friction spinning means or element in the form of, for instance, a perforated drum, a perforated band or belt or a perforated disc for producing a yarn or the like and to a method of use of the friction spinning device.

Generally speaking, the present invention relates to a friction spinning device comprising a friction spinning means or element comprising a selective one of a perforated drum, a perforated band or belt and a perforated disc for a friction spinning device for production of a yarn. The friction spinning device comprises a pneumatic fiber transport passage or channel for transporting freely-floating fibers onto the perforated friction spinning means or element for forming the freely-floating fibers to a yarn at a yarn formation position of the perforated friction spinning means or element. Also provided are means for withdrawing the formed yarn in a predetermined direction. The pneumatic fiber transport passage or channel has an opening disposed substantially parallel to the yarn formation position and at a predetermined spacing therefrom. The pneumatic fiber transport passage or channel is inclined to the yarn formation position at an angle lying substantially between 5° and 90°.

A method and a friction spinning device are known in which freely-floating fibers are so delivered to friction spinning means and are so held by the friction spinning means for transport to a yarn formation position, that on average these fibers define with the yarn formation position an angle greater than 0° but less than 90°; i.e., the fibers are delivered neither in the direction of motion of the friction spinning means nor parallel to the yarn formation position, but in a disposition lying therebetween. In this context, the expression "yarn formation position" refers to that region on the friction spinning means or element on which the so-called yarn end is formed.

In the course of further development, it has been found that a portion of the fibers, dependent upon the speed of the friction spinning means and of the airflow or fiber stream, is laid on the perforated surface of the friction spinning means or element in the aforementioned, undesired directions. This is disadvantageous for yarn formation, particularly as regards yarn strength.

SUMMARY OF THE INVENTION

Therefore, with the foregoing in mind, it is a primary object of the present invention to provide a new and improved method and apparatus for friction spinning which do not exhibit the aforementioned drawbacks and shortcomings of the prior art constructions.

Another and more specific object of the present invention aims at providing a new and improved method and apparatus of the previously mentioned type in which the arrangement of the holes or perforations forming the perforation of the perforated surface of the perforated friction spinning element is such that each straight line joining the centers of the holes or perforations defines with the yarn formation position an angle which is greater than 0° but less than 90°.

Now in order to implement these and still further objects of the invention, which will become more readily apparent as the description proceeds, the apparatus of the present invention is manifested by the features that the perforated friction spinning element has perforations arranged such that straight lines joining individual ones of the perforations are inclined to the yarn formation position at a predetermined angle relative to the pneumatic fiber transport passage or channel. This inclination of the aforementioned straight lines defines, relative to the yarn formation position, an angle which is substantially between 0° and 90°. This angle is opposite in sense to the angle at which the pneumatic fiber feed channel is inclined relative to the yarn formation position.

The method aspects of the present invention are manifested by the features that they comprise the steps of selecting the speed and quantity of an airflow delivering fibers onto a perforated surface of the friction spinning means or element such that the fibers lie on the perforated surface of this friction spinning means or element in a direction of rows of perforations of the perforated surface. The method aspects of the present invention also entail selecting a relation between air speed in a pneumatic fiber transport passage and speed of movement of the perforated friction spinning element or means such that the fibers perform a so-called "somersault" upon impacting against or being caught by the perforated friction spinning means or element and such that the fibers come to lie on the perforated friction spinning element or means in a disposition which has an inclination oppositely disposed to the inclination of the pneumatic fiber transport passage or channel.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

Figure 1:
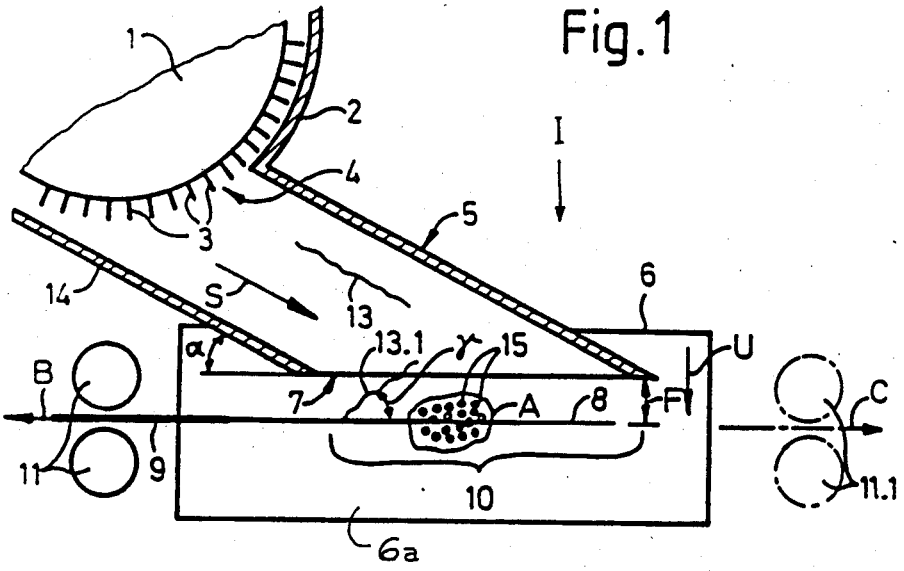
FIG. 1 shows a longitudinal section through the friction spinning device according to the invention, schematically illustrated.

DETAILED DESCRIPTION OF THE PREFERRED EMBODIMENTS:

Describing now the drawings, it is to be understood that to simplify the showing thereof only enough of the structure of the friction spinning device has been illustrated therein as is needed to enable one skilled in the art to readily understand the underlying principles and concepts of this invention. Turning now specifically to FIG. 1 of the drawings, the apparatus illustrated therein by way of example and not limitation and employed to realize the method as hereinbefore described will be seen to comprise a friction spinning device including a schematically indicated opening roller 1 known to the art from the rotor spinning or open-end spinning process. This opening roller 1 is drivably supported within an only partially illustrated housing 2. The opening roller 1 is provided in a known manner with needles 3 or other suitable implements such as not particularly shown teeth for opening a fiber sliver into individual fibers 13.

As already mentioned, opening assemblies with such opening rollers are known to the art from rotor spinning or open-end spinning, and therefore the opening roller 1 will not be here further described.

The housing 2 has a fiber exit opening 4 adjoined by a pneumatic fiber transport passage or channel or duct 5 which subsequently opens onto a cylindrical surface 6*a* of a rotating friction spinning drum 6. This cylindrical surface 6*a* defines a perforated friction spinning surface of the perforated friction spinning drum 6. The perforated friction spinning drum 6 defines a friction spinning means or element.

Figure 3:
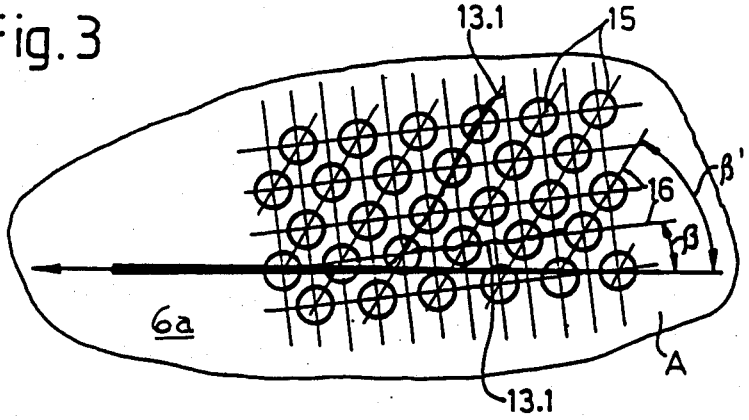
FIG. 3 shows a detail taken from the friction spinning device of FIG. 1, illustrated on an enlarged scale.
Figure 4:
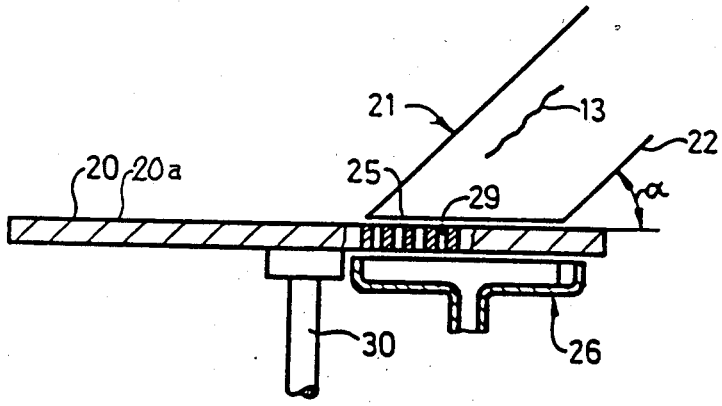
FIG. 4 shows a section through a modification of the friction spinning device according to the invention taken along the line II—II of FIG. 5, illustrated schematically.
Figure 5:
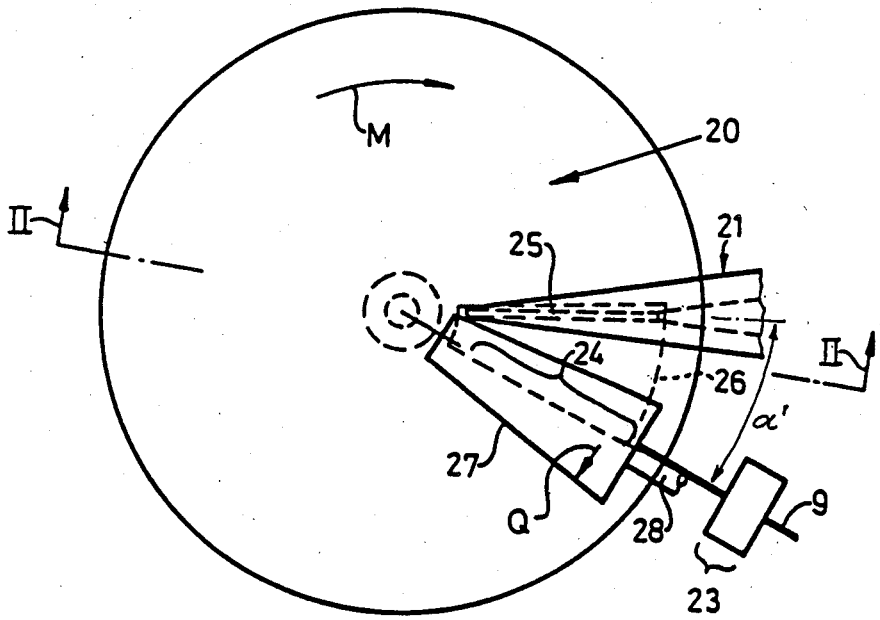
FIG. 5 shows a top plan view of the friction spinning device of FIG. 4 depicting some additional elements not particularly illustrated in FIG. 4.

This rotating perforated friction spinning drum 6, as illustrated in the detail A of FIGS. 1 and 3, is, as stated, perforated and contains a not particularly shown suction duct which defines a suction zone on the periphery of the rotating friction spinning drum 6. Appropriate conventional suction ducts for this purpose are known to the art for generating a negative pressure zone in relation to a perforated friction spinning element such as the perforated friction spinning drum 6. A suction duct 26 of this general type is illustrated in FIGS. 4 and 5 and will be discussed in relation to the modified embodiment illustrated in FIGS. 4 and 5. This suction zone extends from an opening 7 of the pneumatic fiber transport passage or channel 5 up to a yarn end 8 of a yarn 9 or the like, and has a length which corresponds to at least a length L of the passage or channel opening 7. The yarn end 8 is formed in a known manner in the region of a yarn formation position or location 10 on the perforated friction spinning drum 6.

By means of an airstream created by the not particularly shown but conventional suction duct and flowing through the pneumatic fiber transport passage or channel 5, the fibers 13 extracted by the needles 3 and freely floating in the pneumatic fiber transport passage or channel 5 are held within the suction zone on a surface portion of the rotating friction spinning drum 6 defined by or coextensive with the opening 7 of the pneumatic fiber transport passage or channel 5. Finally, the fibers are twisted in the previously mentioned manner in order to form the yarn 9 or the like at the yarn formation position 10. The rotating perforated friction spinning drum 6 rotates in a direction indicated by the arrow U.

The spun yarn 9 is withdrawn by a withdrawal roller pair 11 in a predetermined withdrawal direction B. As seen in FIG. 1, the withdrawal roller pair 11 can also be provided at an oppositely disposed end face of the rotating friction spinning drum 6 as represented by the dotted line roller pair 11.1, i.e. the yarn can also be withdrawn in a further predetermined direction C.

In order to assist in twisting the yarn, the first-mentioned rotating friction spinning drum 6 can be operatively associated with a second friction spinning drum 12, which is arranged so close to the first rotating friction spinning drum 6 that the yarn formed in a convergent space between the two friction spinning drums 6 and 12 is twisted to a stronger yarn 8 than would be formed without this second friction spinning drum 12.

The direction of rotation of the second friction spinning drum 12 corresponds to the direction of rotation of the first rotating friction spinning drum 6, so that both rotational directions are indicated by the same reference character U.

FIG. 1 shows also that the pneumatic fiber transport passage or channel 5 is arranged at an inclination, indicated by the angle $\alpha$, which is less than 90° and which is defined between an imaginary extension of the opening 7 and a lower wall 14 (as viewed in FIG. 1) of the pneumatic fiber transport passage or channel 5.

The opening 7 and the region providing the yarn formation position 10 are substantially mutually parallel but are arranged at a predetermined spacing F relative to each other.

In operation, the fibers 13 are caught at their front ends (as viewed in a flow direction S) when they reach the rotating perforated friction spinning drum 6, and are transported in the peripheral direction indicated by the arrow U towards the yarn end 8. Meanwhile, the succeeding portions of the same fibers 13 are further transported in the flow direction S, so that each fiber 13 performs a so-called "somersault" and comes to lie on the rotating perforated friction spinning drum 6 in a disposition indicated by the angle $\gamma$ and inclined to the yarn formation position 10 by an inclination oppositely disposed relative to the inclination of the pneumatic fiber transport passage 5. A fiber 13 in this disposition is indicated by the reference numeral 13.1. The angle Y is defined by such a fiber 13.1 and the yarn end 8 or by the zone providing or defining the yarn formation position 10.

In the course of experiments it has been found that the disposition of the fiber 13.1 on the rotating perforated friction spinning drum 6 is significantly affected by the relation between the airspeed at the passage or channel opening 7, i.e., the fiber speed at this opening 7, and the peripheral speed of the rotating perforated friction spinning drum 6. For example, it has been found that with an increasing relationship of the airspeed to the peripheral speed of the rotating friction spinning drum 6, the fibers such as the fiber 13.1 in the disposition indicated by the angle $\gamma$ lie on the perforated friction spinning drum 6 with a diminishing angle $\gamma$. On the other hand, if the rotating perforated friction spinning drum 6 has a higher peripheral speed than the free fibers 13 leaving the opening 7, then the fibers 13 are stretched out by the perforated friction spinning drum 6 as they are caught and are taken up substantially in the peripheral direction on the rotating perforated friction spinning drum 6 and in the yarn end 8 forming at the yarn formation position 10.

Furthermore, it has been established that the airstream of the individual holes or perforations 15 providing perforations for the rotating perforated friction spinning drum 6 exerts an influence on the disposition of the fibers 13.1 on the rotating perforated friction spinning drum 6. Subsequent to the "somersault", and dependent upon the intensity of the airstream through the holes or perforations 15, the fibers 13 lie, as indicated for the disposition of the fibers 13.1, along the corresponding row of holes or perforations 15 indicated by the angle $\beta$ (FIG. 3). The fibers 13 may come to rest along the row of holes or perforations 15 at the greater angle $\beta'$ or along the row of holes or perforations 15 at the smaller angle $\beta$ depending upon the relation between airspeed and peripheral speed of the rotating perforated friction spinning drum 6.

Figure 6:
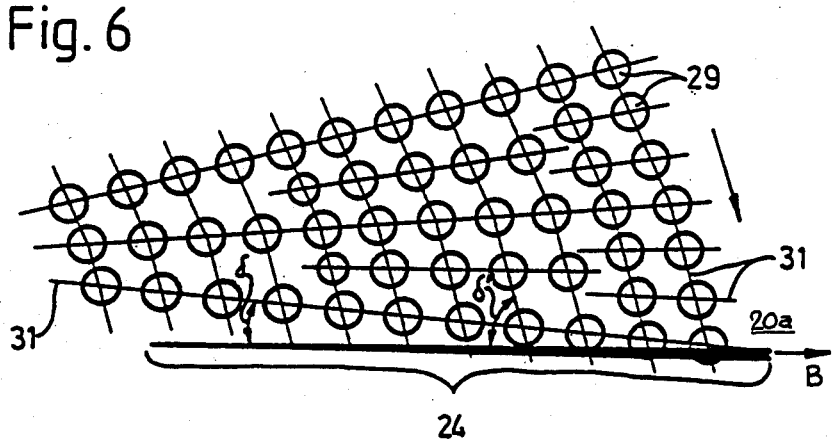
FIG. 6 shows a detail from the friction spinning device of FIG. 5 illustrated on an enlarged scale.

Now, in order to avoid a possible disposition of the fibers 13.1 extending in the peripheral direction of the rotating perforated friction spinning drum 6 or parallel to the yarn end 8 (or the yarn formation position 10), the holes or perforations 15 are arranged such that straight lines 16 joining their centers each define an angle $\beta$ or $\beta'$ relative to the yarn formation position 10 which is greater than 0° but less than 90°. This angle $\beta$ or $\beta'$ is preferably at least 5° and at most 80°. It is particularly advantageous for the lesser (the angle $\beta$) of the two angles $\beta$ and $\beta'$ to be between 10° and 30° so that the majority of the delivered fibers 13 are deposited in this region on the rotating perforated friction spinning drum 6. It is also advantageous for both angles $\beta$ and $\beta'$ to lie between 5° and 75°. The arrangement of the rows of holes or perforations 15 can be varied as shown in FIGS. 3 and 6; it is advantageous for the straight lines 16 joining the centers of the holes or perforations 15 to be arranged such that they form triangles, as shown in FIG. 6, in which at least two sides have the same length.

Furthermore, at least the straight lines 16 joining the centers of the holes or perforations 15 are each oppositely disposed relative to the disposition or orientation of the pneumatic fiber transport passage or channel 5, and are inclined at a predetermined angle $\beta$ or $\beta'$ to the yarn formation position 10. In this way, it can be ensured that the fibers 13 also come to lie in the fiber disposition or orientation indicated by the fiber 13.1 after the so-called "somersault". The fibers 13 at the start or initial portion of the yarn formation position 10, as viewed in the yarn withdrawal direction B, lie in the fiber disposition 13.1 with the lesser angle $\beta$, and the fibers 13 at the end or terminal portion of the yarn formation position 10 lie in this fiber disposition 13.1 at the greater angle $\beta'$. This tendency is supported by those arrangements of the holes or perforations 15 which include rows of holes or perforations 15 with lesser and greater angles $\beta$ and $\beta'$, respectively.

In addition, the speed and quantity of the airstream delivering the fibers 13 to the perforated surface of the friction spinning means or element can be chosen such that there is a significant possibility that the fibers 13 will lie in one of the two directions indicated by the angles $\beta$ and $\beta'$ on the perforated surface of the friction spinning means or element. This ensures that substantially no fibers 13 will come to rest on the rotating perforated friction spinning drum 6 parallel to the yarn end 8 or at right angles thereto. This intensity of the airstream is dependent upon the negative pressure or vacuum in the not particularly shown but conventional suction duct heretofore discussed, upon the free air through-flow area through the holes or perforations 15, and upon the possibility of drawing the air by suction into the pneumatic fiber transport passage or channel 5. For those fibers 13 which lie on the rows of holes or perforations 15 in accordance with angle $\beta$, the angle $\gamma$ is equivalent to the angle $\beta$.

The interplay of the aforementioned three conditions must be determined from case to case. For example, a decision must be reached primarily as concerns the diameter of the holes or perforations 15 and the spacing therebetween, and the negative pressure or suction in the not particularly shown suction duct will be selected accordingly in dependence of the required air quantity (m3/min.).

FIGS. 4 and 5 show a modification of the friction spinning device according to the invention in which a perforated friction spinning disc or plate 20 is provided in place of a friction spinning drum. The perforated friction spinning disc 20 is supplied with freely-floating fibers 13 by means of a pneumatic fiber transport passage or channel 21. The pneumatic fiber transport passage 21 also has an inclination indicated by the angle $\alpha$ similar to that of the previously discussed pneumatic fiber transport passage or channel 5. This inclination angle $\alpha$ is defined by a lower wall 22 (as viewed in FIG. 4) of the pneumatic fiber transport passage or channel 21, and by the perforated surface 20*a* of the friction spinning disc 20.

From FIG. 5 it can be seen that the yarn 9 or the like is withdrawn by a withdrawal roller pair 23 and that this yarn 9 is formed at a yarn formation position or location 24 which is spaced or remote from an opening 25 of the pneumatic fiber transport passage or channel 21.

This yarn formation position 24 is situated in an analogous manner in the border region of a suction duct 26 located below the friction spinning disc 20 (as seen in FIG. 4). This suction duct 26 extends from the opening 25 of the pneumatic fiber transport passage or channel 21 to the yarn formation position 24, as indicated in dotted lines in FIG. 5.

Figure 2:
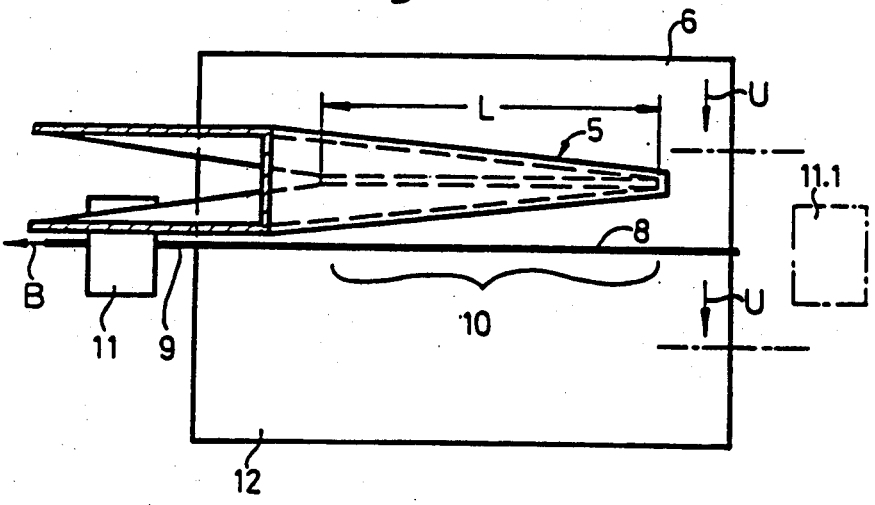
FIG. 2 shows a plan view of part of the friction spinning device of FIG. 1 viewed in the direction I.

In place of the second friction spinning drum 12 indicated in FIG. 2, this modification includes a conical roller 27 which is rotatably and drivably supported by means of a driven shaft 28.

Furthermore, in a similar manner to the rotating perforated friction spinning drum 6, the perforated friction spinning disc 20 is perforated over a width corresponding to at least the length of the yarn formation position or location 24 with open-ended or continuous holes or perforations 29 passing therethrough (only partially illustrated in FIG. 4), so that the suction duct 26 is able to draw by suction through the holes or perforations 29 the transport air required for transport of the infed fibers 13.

Also, in a manner similar to the perforated friction spinning drum 6, the holes or perforations 29 of the perforated friction spinning disc 20 are so arranged that straight lines 31 joining the centers of these holes or perforations 29 define with the yarn formation position 24 angles $\delta$ and $\delta'$ (FIG. 6) each of which is greater than 0° and less than 90°.

Furthermore, the same conditions apply as defined for the perforated friction spinning drum 6 with reference to the maxima and minima of the angles $\beta$ and $\beta'$ discussed previously with respect to the embodiment shown in FIG. 3 and the arrangement of the rows of holes or perforations 29 of the embodiment now under discussion with reference to FIGS. 4 to 6. In particular, also in this modification, at least two of the straight lines joining the centers of the holes or perforations 29 are each inclined at a predetermined angle $\delta$ or $\delta'$ to the yarn formation position or location 24 and this angle $\delta$ or $\delta'$ is opposite in sense to an angle $\alpha'$ at which the pneumatic fiber feed passage or channel 21 is disposed relative to the yarn formation position or location 24. On the other hand, the rows of holes or perforations 29 must be arranged within predetermined circular segments, as illustrated in FIG. 6, since they are arranged upon a disc surface 20*a* and not on a drum surface.

If the fibers 13 are transported in the described manner towards the perforated friction spinning disc 20, then they also have the tendency to lie on the perforated surface 20*a* of the perforated friction spinning disc 20 in the direction of the rows of holes or perforations 29 in accordance with the angle $\delta$ or $\delta'$. In this way, the fibers 13 are also taken up by the yarn end 8 at the yarn formation position or location 24 (or are twisted around this yarn end 8) with the already described angle $\gamma$ (see FIG. 1). If the fibers 13 lie exactly on the rows of holes or perforations 29 with the angle $\delta$ or $\delta'$, then the angle Y is equivalent to the angle $\delta$ or $\delta'$.

The friction spinning disc 20 is rotatably and drivably supported by means of a shaft 30 and rotates in the direction M (FIG. 5). The conical roller 27 rotates in the direction Q.

Clearly, it is also possible to use a suitable, not particularly shown but conventional, friction spinning band or belt in place of the perforated friction spinning drum 6 or the friction spinning disc 20. In such a case, the arrangement of the holes or perforations forming the perforations or the like is provided in a manner similar to the perforations 15 on the perforated friction spinning drum 6. Friction spinning bands or belts are known to the art from the patent literature dealing with friction spinning. Thus, conceptually the perforated friction spinning elements 6 and 20 can be considered to also constitute a perforated band or belt.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A friction spinning device for production of a yarn or the like comprising:

a perforated friction spinning means having a yarn formation position;

means defining a pneumatic fiber transport passage for transporting freely-floating fibers onto the friction spinning means for forming said freely-floating fibers into a yarn at said yarn formation position;

means for withdrawing said formed yarn in a predetermined withdrawal direction;

said pneumatic fiber transport passage having an opening disposed in a predetermined position relative to said yarn formation position and at a predetermined spacing therefrom;

said pneumatic fiber transport passage being inclined to said yarn formation position at an angle substantially between 5° and 90°; and the perforated friction spinning means having perforations arranged such that straight lines joining individual ones of said perforations are inclined relative to said yarn formation position in a sense opposite to said inclined pneumatic fiber transport passage and define relative to said yarn formation position an angle substantially between 0° and 90°.

2. The friction spinning device as defined in claim 1, wherein:

said straight lines joining said individual perforations respectively define two angles of different magnitude within the range between 0° and 90°.

3. The friction spinning device as defined in claim 2, wherein:

one angle of said two angles is at most 80°.

4. The friction spinning device as defined in claim 2, wherein:

one angle of said two angles is at least 5°.

5. The friction spinning device as defined in claim 2, wherein:

said two angles lie substantially between 5° and 75°.

6. The friction spinning device as defined in claim 5, wherein: one angle of said two angles lies between 10° and 30°.

7. The friction spinning device as defined in claim 1, wherein:

said perforated friction spinning means comprises a perforated friction spinning drum.

8. The friction spinning device as defined in claim 1, wherein:

said perforated friction spinning means comprises a perforated friction spinning disc.

9. The friction spinning device as defined in claim 1, wherein:

said perforated friction spinning means comprises a perforated friction spinning belt.

10. A friction spinning device for production of a yarn or the like comprising:

a perforated friction spinning means having a yarn formation position;

means defining a pneumatic fiber transport passage for transporting freely-floating fibers onto the friction spinning means for forming said freely-floating fibers into a yarn at said yarn formation position;

means for withdrawing said formed yarn in a predetermined withdrawal direction;

said pneumatic fiber transport passage having an opening disposed in a predetermined position relative to said yarn formation position and at a predetermined spacing therefrom;

said pneumatic fiber transport passage being inclined to said yarn formation position at an angle substantially between 5° and 90°; and the perforated friction spinning means having perforations arranged such that straight lines joining individual ones of said perforations are inclined relative to said yarn formation position and define relative to said yarn formation position an angle substantially between 0° and 90°.

11. A method of use of a friction spinning device comprising friction spinning means having an axis of rotation and a perforated surface with perforations arranged in rows, comprising the steps of:

selecting the speed and quantity of an airflow delivering fibers onto the perforated surface of the friction spinning means such that said fibers lie on the perforated surface of the friction spinning means substantially in the direction of the rows of perforations of said perforated surface and at an inclination relative to the axis of rotation of the friction spinning means.

12. A method of use of a friction spinning device containing friction spinning means having a perforated surface, a pneumatic fiber transport passage and a yarn formation position for the formation of a yarn from fibers, comprising the steps of:

selecting a relation between an airspeed in the pneumatic fiber transport passage and a speed of movement of the perforated friction spinning means of the friction spinning device such that the fibers perform a so-called "somersault" upon engagement with the friction spinning means and such that the fibers come to lie on the friction spinning means in a disposition which has an inclination relative to the yarn formation position which is oppositely disposed to an inclination of the pneumatic fiber transport passage relative to the yarn formation position.

13. A method of use of a friction spinning device containing friction spinning means having a perforated surface, a pneumatic fiber transport passage and a yarn formation position for the formation of a yarn from fibers, comprising the steps of:

selecting a relation between an airspeed in the pneumatic fiber transport passage and a speed of movement of the perforated friction spinning means of the friction spinning device such that the fibers perform a so-called "somersault" upon engagement with the friction spinning means and such that the fibers come to lie on the friction spinning means in a disposition which has an inclination relative to the yarn formation position.

* * * * *

UNITED STATES PATENT AND TRADEMARK OFFICE

CERTIFICATE OF CORRECTION

PATENT NO. : 4,696,155

DATED : September 29, 1987

INVENTOR(S) : HERBERT STALDER et al

It is certified that error appears in the above-identified patent and that said Letters Patent is hereby corrected as shown below:

Column 4, line 57, after "angle" please delete "Y" and insert --γ-- (Gamma)

Column 7, line 35, at the beginning of the line, please delete "Y" and insert --γ-- (Gamma)

Signed and Sealed this

Twenty-second Day of March, 1988

*Attest:*

*Attesting Officer*

DONALD J. QUIGG

*Commissioner of Patents and Trademarks*